United States Patent [19]

Hartman et al.

[11] Patent Number: 5,058,774

[45] Date of Patent: Oct. 22, 1991

[54] METHOD OF AND APPARATUS FOR DETECTING AND COLLECTING SPILLED FUEL PRODUCTS

[76] Inventors: Earl D. Hartman, 8354 Gresham Ave., Richmond, Va. 23237; Walter F. Atkins, 4003 Dubet La., Richmond, Va. 23234

[21] Appl. No.: 518,995

[22] Filed: May 4, 1990

[51] Int. Cl.[5] ..... B67D 5/32

[52] U.S. Cl. ..... 222/140; 222/108

[58] Field of Search ..... 222/108, 109, 564, 71, 222/23, 25, 1, 40; 137/312; 141/86

[56] References Cited

U.S. PATENT DOCUMENTS

| | | | |
|---|---|---|---|
| 2,286,476 | 6/1942 | Eickmeyer | 222/71 |
| 2,309,997 | 2/1943 | Thieman | 222/564 |
| 3,337,418 | 8/1967 | Halacy, Jr. | 202/83 |
| 3,940,940 | 3/1976 | Barrett | 61/1 R |
| 4,278,115 | 7/1981 | Briles et al. | 141/86 |
| 4,313,457 | 2/1982 | Cliff | 222/108 |
| 4,382,723 | 5/1983 | Moëller | 222/564 |
| 4,662,539 | 5/1987 | Komukai | 222/14 |
| 4,762,440 | 8/1988 | Argandona | 405/52 |
| 4,763,806 | 8/1988 | Podgers et al. | 220/86 R |
| 4,842,163 | 6/1989 | Bravo | 222/40 |
| 4,842,443 | 6/1989 | Argandona | 405/52 |

*Primary Examiner*—Michael S. Huppert
*Assistant Examiner*—Philippe Derakshani
*Attorney, Agent, or Firm*—Richard P. Matthews

[57] ABSTRACT

A method of and apparatus for detecting and collecting spilled fuel products from fuel dispensers of the type that are customarily mounted on a raised concrete island. One or more deflectors are mounted within a casing for the fuel dispenser at an elevation higher than the raised island. The deflectors serve to redirect the spilled fuel onto the top of the raised island so that the existence of the spilled fuel may be detected and corrected. It is possible for the deflectors to include channel members and for the spilled fuel to be delivered to more than one location on the island. In another embodiment of the invention, the spilled fuel product is conveyed to a flame and vapor safe container for disposal or recovery.

9 Claims, 2 Drawing Sheets

METHOD OF AND APPARATUS FOR DETECTING AND COLLECTING SPILLED FUEL PRODUCTS

This invention relates to a method of and apparatus for detecting and collecting spilled fuel products and, more particularly, to such a method and apparatus for redirecting spilled fuel products by deflector means mounted within the casing of a fuel dispenser above the level of an island or any other foundation on which a fuel dispenser is mounted.

BACKGROUND OF THE INVENTION

Heretofore it has been known to alert a gasoline station operator that leaks or spills were occurring from a service station dispenser. One such apparatus is shown in U.S. Pat. No. 4,842,163 issued on June 27, 1989 to Bravo. This apparatus utilizes a gasoline collector pit box and a float mechanism disposed therein to shut off the flow of gasoline when a predetermined amount of gasoline accumulates in the bottom of the pit box. The pit box and float mechanism are mounted below the level of the island. Although this device amplifies the effect of accumulation by slanting the bottom wall of the pit box and by increasing the length of the pivot arm to which the float is attached, it still requires the accumulation of too much gasoline and its associated harmful vapors before shut down occurs. The accumulation of vapors within the pit box creates a situation which is extremely dangerous to anyone who attempts to service these pumps and restore them to satisfactory operation.

SUMMARY OF THE PRESENT INVENTION

In accordance with the present invention, the previously described shortcomings and disadvantages of the known prior art are effectively overcome in the practice of the present invention. In particular, in accordance with one embodiment of the present invention, a deflector means is positioned with the gasoline dispenser above the level of the raised island or any other foundation on which a fuel dispenser is mounted. The deflector means may include channel means into which the spilled fuel is cascaded by gravity flow and which is directed to a predetermined point or points on top of the raised island. By this means the existence of a leak or fuel spill is immediately evident and detected and may be seen by the station operator or one of the station operator's customers. A cleanup operation or closing down of the pump may be effected immediately without the dangerous and potentially harmful buildup of fumes which may last for days or weeks in other devices employing submerged open pit box containers.

In a modified form of the invention, deflector means are again positioned within the casing of the fuel dispenser at an elevation above the upper surface of a raised island on which the fuel dispenser is mounted. The deflector means also includes channel means into which the spilled fuel is cascaded by gravity flow. Conduit means communicating with the channel means in one or more positions are used to convey the spilled fuel to a flame and vapor safe container for disposal or recovery.

In both forms of the invention a plurality of deflector means may be employed.

The inherent advantages and improvements of the present invention will become more readily apparent by reference to the following detailed description of the invention and by reference to the drawings wherein.

DETAILED DESCRIPTION OF THE INVENTION

Figure 1:
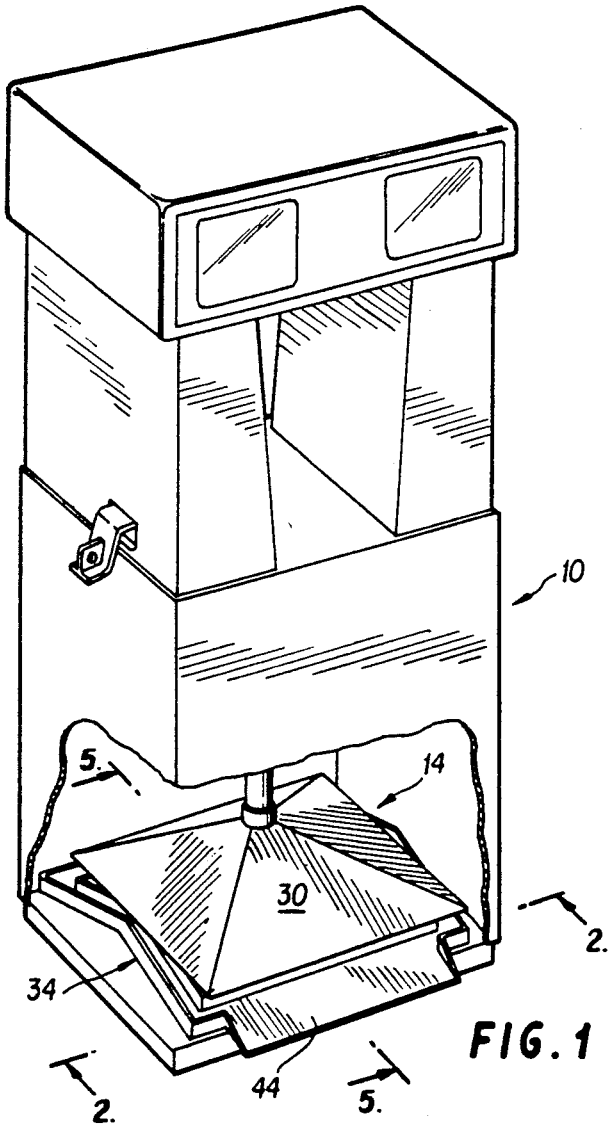
FIG. 1 is a perspective view of a fuel dispensing pump with portions broken away to illustrate the present invention.

Referring nov to FIG. 1 of the drawings, there is shown generally at 10 a casing for a fuel pump such as are customarily found at gas stations. Casing 10 is mounted in customary fashion on the upper surface 12 (see FIGS. 2 and of a raised platform, island or any foundation on which a fuel dispenser is mounted.

The location of deflector means is indicated generally at 14 in a broken away section of casing 10. The function of the deflector means 14 is to divert spilled fuel products by gravity flow onto a predetermined location or locations onto surface 12 of the raised platform or island as will be explained in detail hereinafter.

Figure 2:
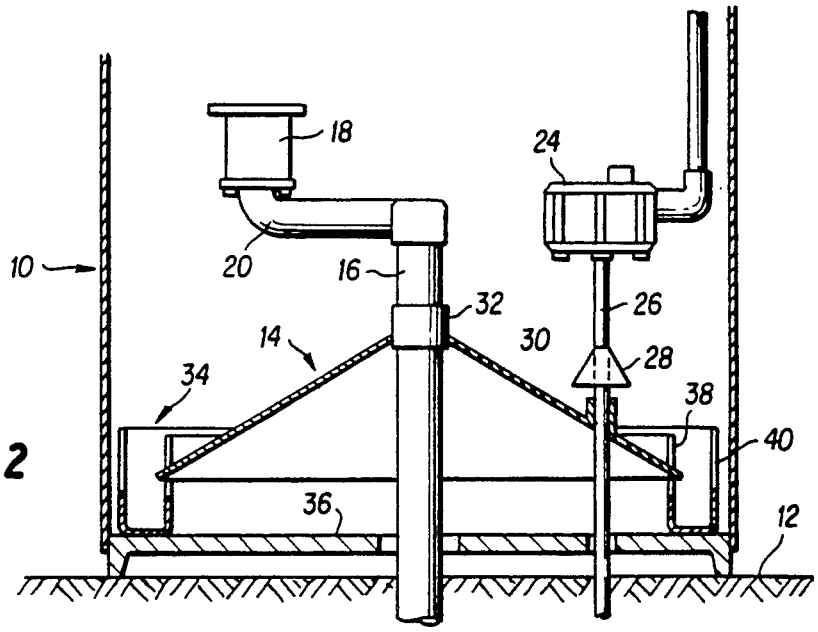
FIG. 2 is a fragmentary elevational view of the fuel dispensing pump of FIG. 1 drawn to an enlarged scale and taken in vertical cross section along line 2—2 of FIG. 1.

Referring now to FIG. 2 of the drawings, a portion of a gasoline fuel pump dispenser is illustrated for reference purposes only. It will be understood that the invention is applicable to fuel products generally and is not limited to gasoline only. Thus, there is shown a fuel product inlet pipe 16 which delivers fuel from an underground source, not shown, to a strainer housing 18 by means of connecting pipe 20. An electrical box 24 is provided with a depending electrical conduit 26 which has an auxiliary deflector 28 secured thereto which is routed through a main deflector 30 to its power source.

Figure 3:
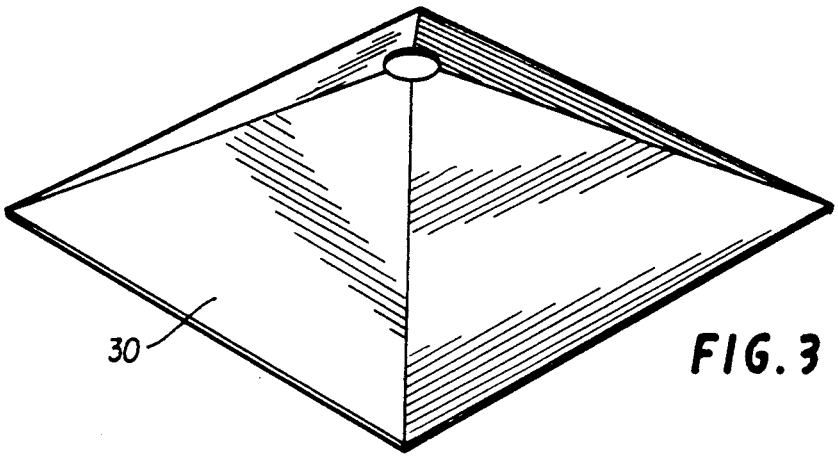
FIG. 3 is a perspective view of a deflector plate of FIG. 1 drawn to an enlarged scale.
Figure 4:
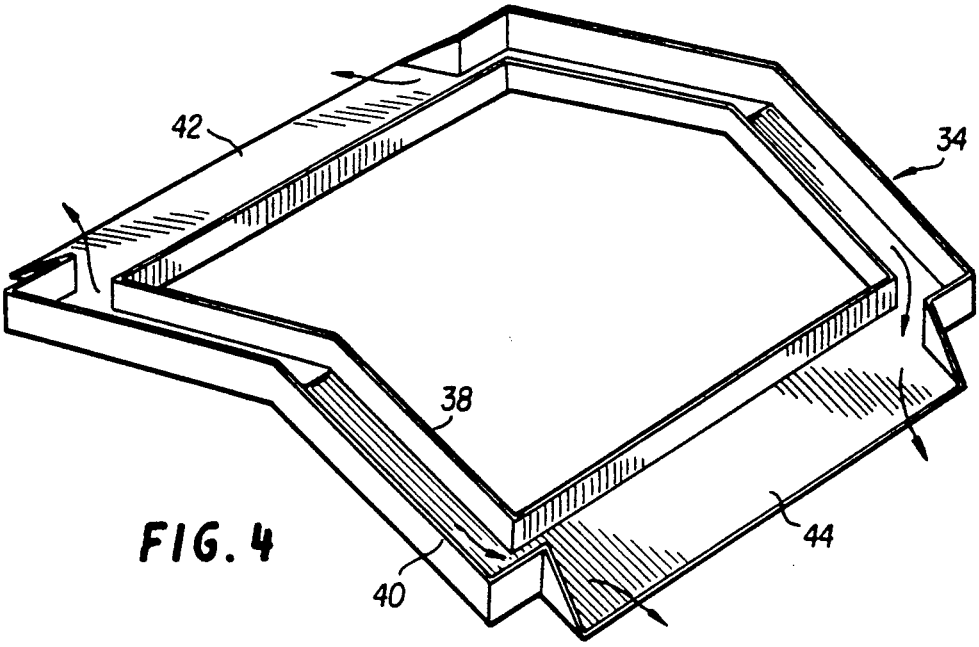
FIG. 4 is a perspective view of another deflector and channelling means of FIG. 1 drawn to an enlarged scale.

Main deflector 30 is shown in FIG. 2 suitably secured to inlet pipe 16 by means of a collet or collar 32. A perspective view of main deflector 30 is shown in FIG. 3. Channel means, indicated generally at 34, are included in the deflector means 14. The channel means 34 are supported on base 36 of the gasoline pump which also supports casing 10. A channel is formed between a continuous upstanding inner wall 38 and upstanding outer wall 40. The outer wall 40 is shown to be provided with dispensing troughs 42, 44 on opposed sides of channel means 34 whereby spilled fuel products are deposited by gravity flow onto the top surface 12 of the raised platform or island.

Figure 5:
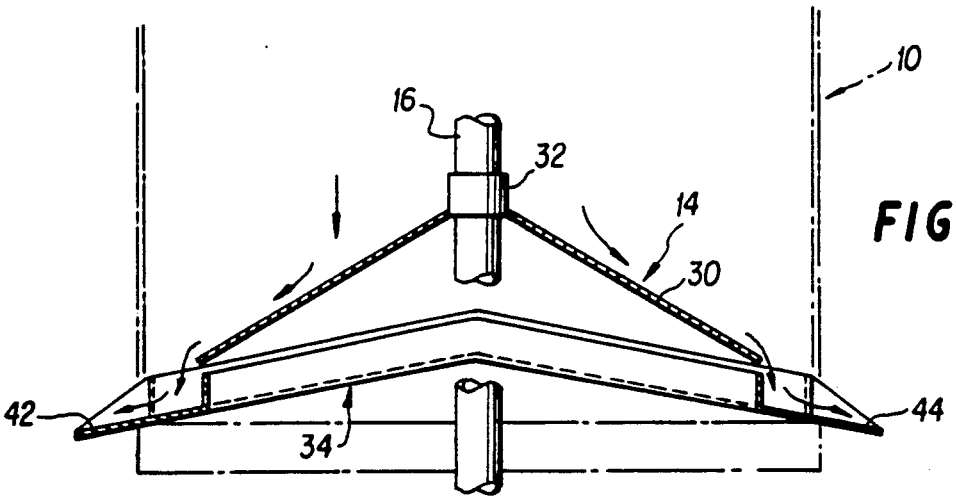
FIG. 5 is a fragmentary elevational view taken in vertical cross section along line 5—5 of FIG. 1 and drawn to an enlarged scale.

The width of the dispensing troughs 42, 44 may be made of any convenient size. Although two dispensing troughs are illustrated, it is to be understood that the channel means 34 can be designed to deposit spilled fuel products at a single location on top surface 12 of the raised platform or island. As many auxiliary deflectors may be used as desired so long as the spilled fuel product cascades from one deflector to another and ultimately into the channel means by gravity flow. The cascading flow is schematically shown in FIG. 5 with the arrows showing the progressive movement of spilled fuels.

Figure 6:
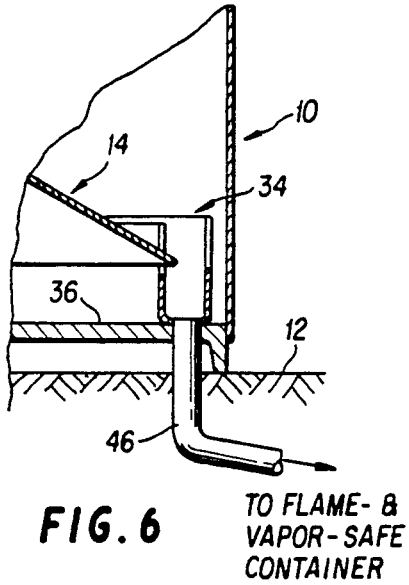
FIG. 6 is a fragmentary elevational view showing a modification of the structure shown in FIG. 2.

A modification of the present invention is shown in FIG. 6. In this figure, the deflector means 14 which includes the channel means 34 are mounted within casing 10 above the elevation of the top surface 12 of the conventional concrete platform or island. One or more pipes or conduits 46 constitutes conduit means which communicate with channel means 34 to deliver the spilled fuel products to a flame and vapor safe container as is indicated by the legend. Gas station operators would probably prefer this modification of the invention for all their new installations, but existing installations may be retrofitted to be made safe from explosions, fires and environmental contamination by the use of the method and apparatus shown in FIGS. 1–5.

While presently preferred embodiment of the invention have been illustrated and described, it will be recognized that the invention may be otherwise variously embodied and practiced within the scope of the claims which follow.

We claim:

1. An apparatus for detecting spilled fuel products wherein a casing for a fuel dispenser is mounted on a raised island or other foundation on which said fuel dispenser is mounted, said casing having at least one inlet fuel pipe and at least one electrical conduit pipe therein, said apparatus comprising:

a. deflector means mounted within said casing at an elevation higher than said raised island,
   i. said inlet fuel pipe and said electrical conduit pipe extending through said deflector means,
   ii. said deflector means serving to redirect spilled fuel products onto said raised island thereby detecting the existence of a spilled fuel product within said casing.

2. An apparatus for detecting spilled fuel products as defined in claim 1 wherein said deflector means includes channel means for directing a spilled fuel product onto said island or other foundation.

3. An apparatus for detecting spilled fuel products as defined in claim 1 wherein said spilled fuel products cascades from a deflector member of said deflector means to said channel means.

4. An apparatus for detecting spilled fuel products as defined in claim 1 wherein said deflector means and channel means deflects spilled fuel products onto said island or other foundation at more than one location.

5. An apparatus for collecting spilled fuel products wherein a casing for a fuel dispenser is mounted on a raised island or other foundation, said casing having at least one inlet fuel pipe and at least one electrical conduit pipe therein, said apparatus comprising:

a. deflector means mounted within said casing at an elevation higher than said raised island,
   i. said inlet fuel pipe and said electrical conduit pipe extending through said deflector means,
   ii. said deflector means including channel means,
b. and conduit means communicating with said channel means to deliver said spilled fuel products to a flame and vapor safe container.

6. A method of detecting spilled fuel products from a fuel dispensing apparatus having a casing mounted on a raised island or other foundation, said casing having at least one inlet fuel pipe and at least one electrical conduit pipe therein, said method comprising the steps of a. positioning deflector means within said casing at an elevation higher than said raised island or other foundation,
b. passing said inlet fuel pipe and said electrical conduit pipe through said deflector means,
c. and directing said spilled fuel products by said deflector means onto said raised island or other foundation.

7. A method of detecting spilled fuel products as defined in claim 6 including the additional step of directing said spilled fuel products to a plurality of positions on said island or other foundation.

8. A method of detecting spilled fuel products as defined in claim 6 wherein said deflector means includes channel means and said method includes the step of cascading said spilled fuel products by gravity flow from said deflector means to said channel means.

9. A method of collecting spilled fuel products from a fuel dispensing apparatus having a casing mounted on a raised island or other foundation, said casing having at least one inlet fuel pipe and at least one electrical conduit pipe therein, said method comprising the steps of a. positioning deflector means within said casing at an elevation higher than said raised island or other foundation,
b. passing said inlet fuel pipe and said electrical conduit pipe through said deflector means,
c. including channel means in said deflector means,
d. and conveying said spilled fuel product from said channel means to a flame and vapor safe container.

* * * * *